US005898428A

United States Patent [19]

Zimlich et al.

[11] Patent Number: 5,898,428

[45] Date of Patent: *Apr. 27, 1999

[54] HIGH IMPEDANCE TRANSMISSION LINE TAP CIRCUIT

[75] Inventors: David A. Zimlich; Garrett W. Hall, both of Boise, Id.

[73] Assignee: Micron Display Technology Inc., Boise, Id.

[ * ] Notice: This patent issued on a continued prosecution application filed under 37 CFR 1.53(d), and is subject to the twenty year patent term provisions of 35 U.S.C. 154(a)(2).

[21] Appl. No.: 08/746,965

[22] Filed: Nov. 19, 1996

[51] Int. Cl.[6] ..... G09G 5/00

[52] U.S. Cl. ..... 345/211; 345/204

[58] Field of Search ..... 345/205, 211, 345/204, 55

[56] References Cited

U.S. PATENT DOCUMENTS

| | | | |
|---|---|---|---|
| 4,651,149 | 3/1987 | Takeda et al. | 340/805 |
| 4,654,649 | 3/1987 | Kojima et al. | 345/205 |
| 5,404,081 | 4/1995 | Kane et al. | 315/169.1 |
| 5,519,414 | 5/1996 | Gold et al. | 345/208 |
| 5,528,256 | 6/1996 | Erhart et al. | 345/87 |
| 5,633,600 | 5/1997 | Ohnishi | 326/17 |

*Primary Examiner*—Amare Mengistu
*Assistant Examiner*—Ricardo Osorio
*Attorney, Agent, or Firm*—Seed & Berry LLP

[57] ABSTRACT

A transmission line tap for a field emission display includes a driving circuit formed from a charging and clearing circuit and a storage circuit. In one embodiment, the charging and clearing circuit is a single transistor coupled between a supply voltage and the storage circuit. The storage circuit is a single storage capacitor coupled between the transistor and the reference potential. In another embodiment, the charging and clearing circuit is formed from three transistors and an intermediate capacitor, and the storage circuit is formed from a storage capacitor and an output buffer. In either embodiment, pulses of an input voltage selectively charge the storage capacitor to a fixed voltage. The driving circuit then drives a column line of an emitter substrate in response to the storage capacitor. In the first embodiment, the storage capacitor is cleared by pulsing the supply voltage. In the second embodiment, the charging and clearing circuit is self-clearing such that no pulse of the supply voltage is required. Each embodiment is driven by a transmission line using constructively interfered pulses to establish the input voltage.

34 Claims, 5 Drawing Sheets

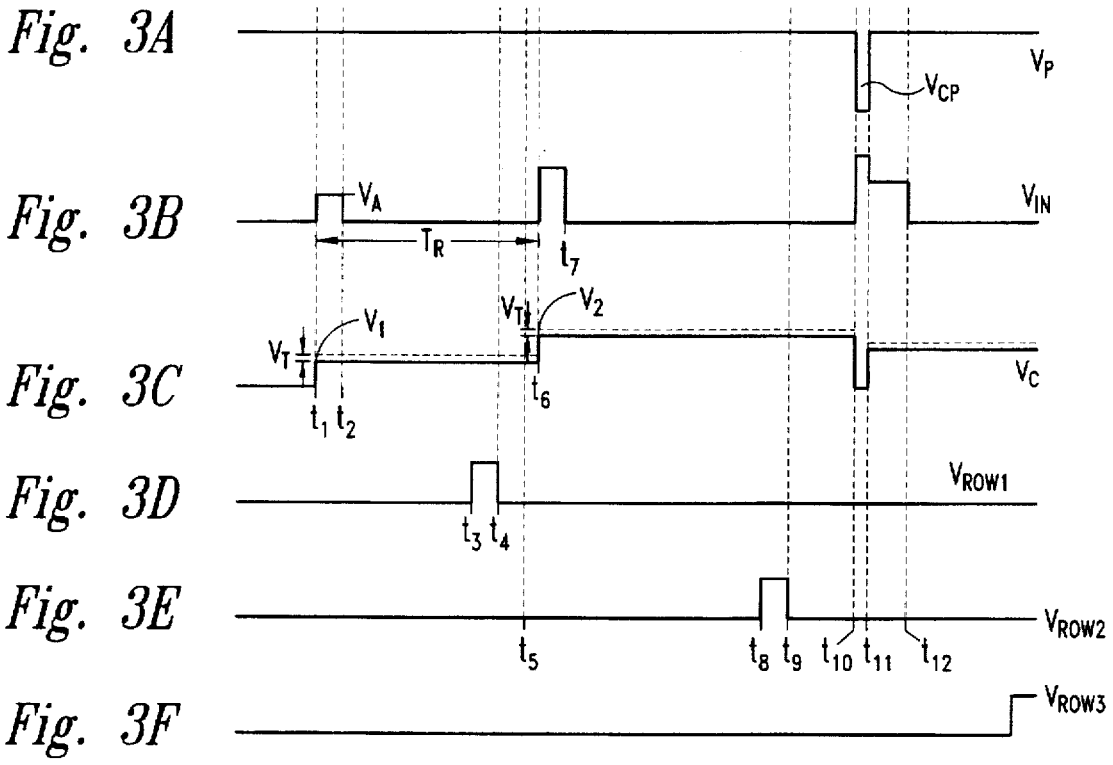
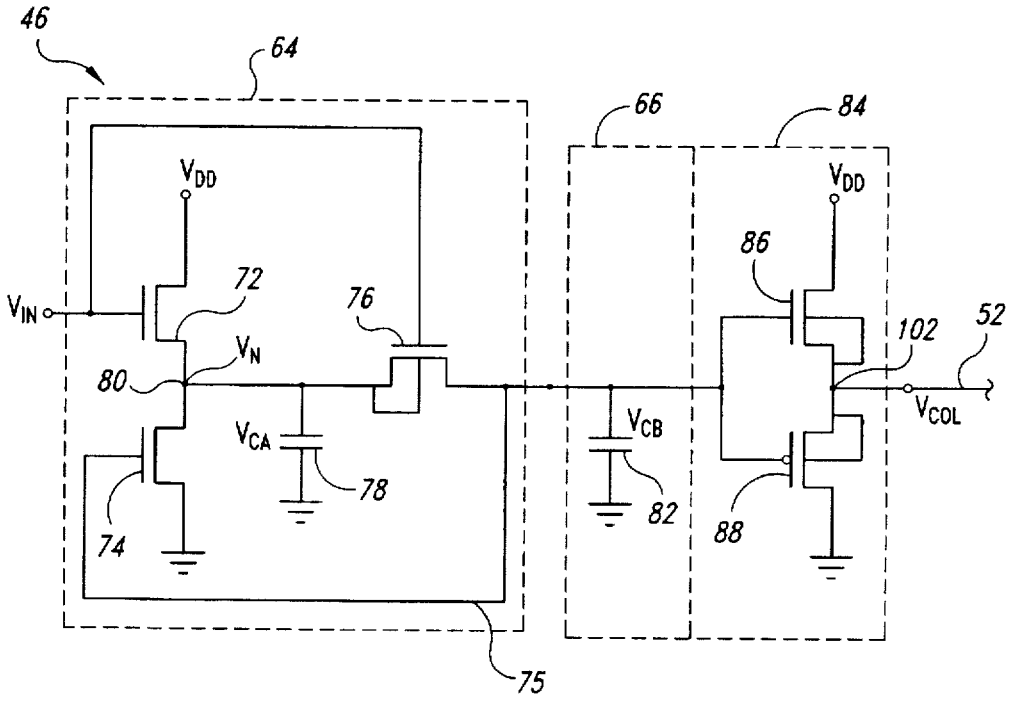
Fig. 4

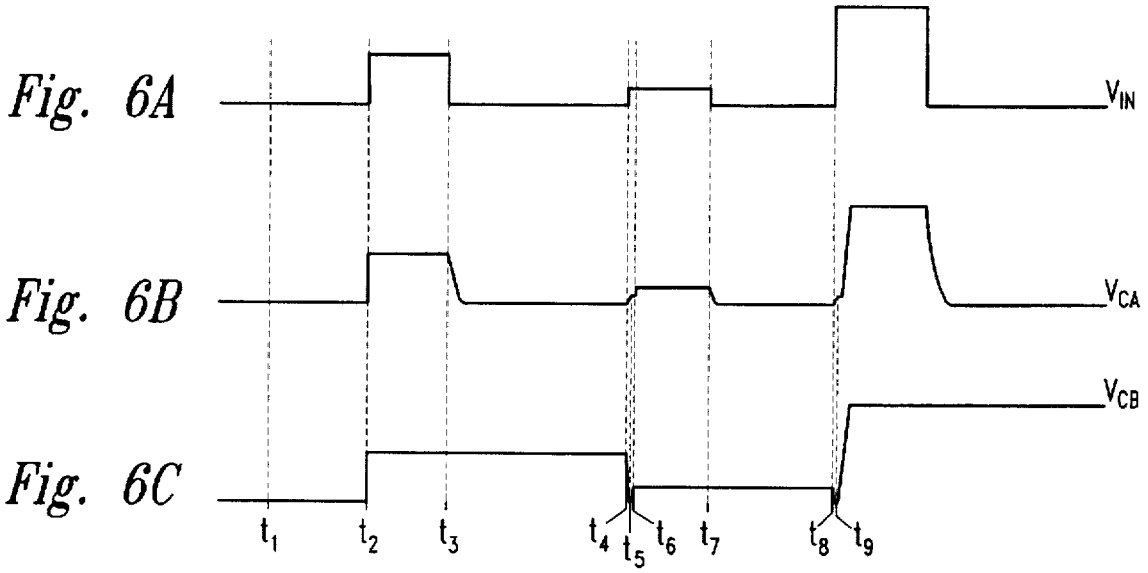
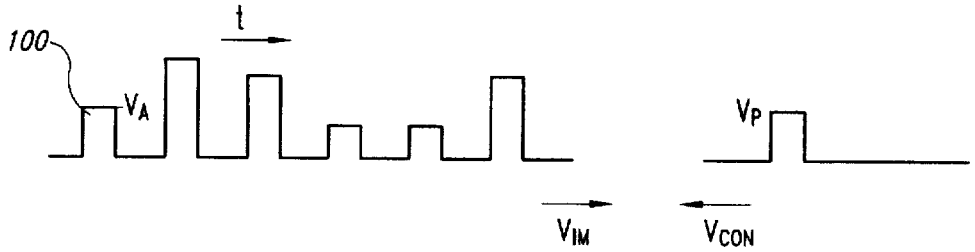
Fig. 8A
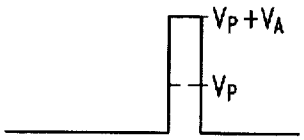
Fig. 8B

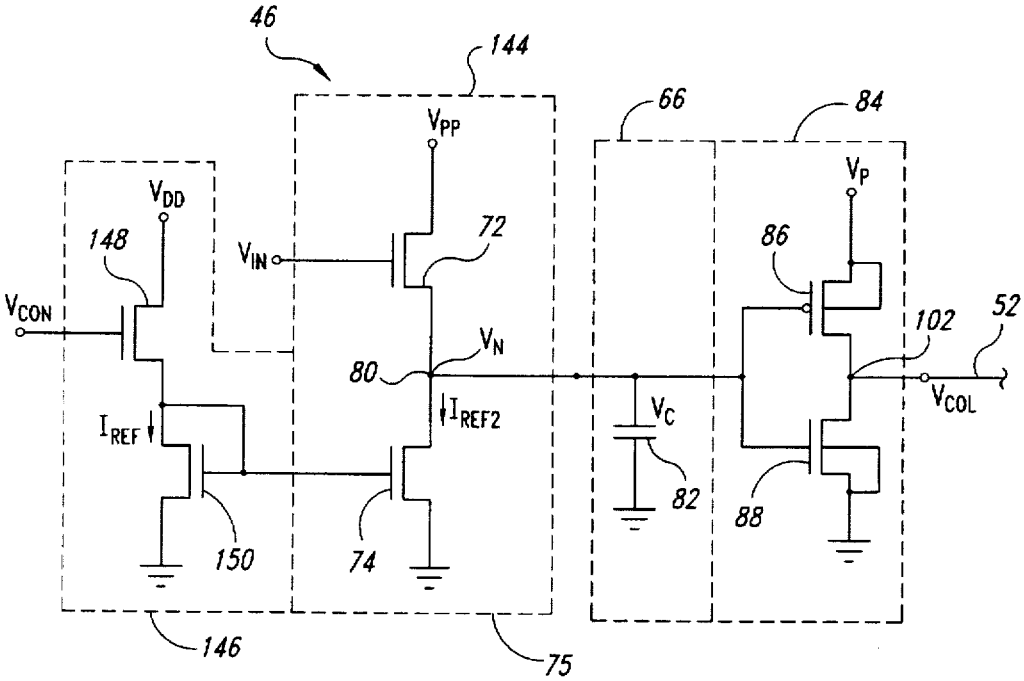
Fig. 9
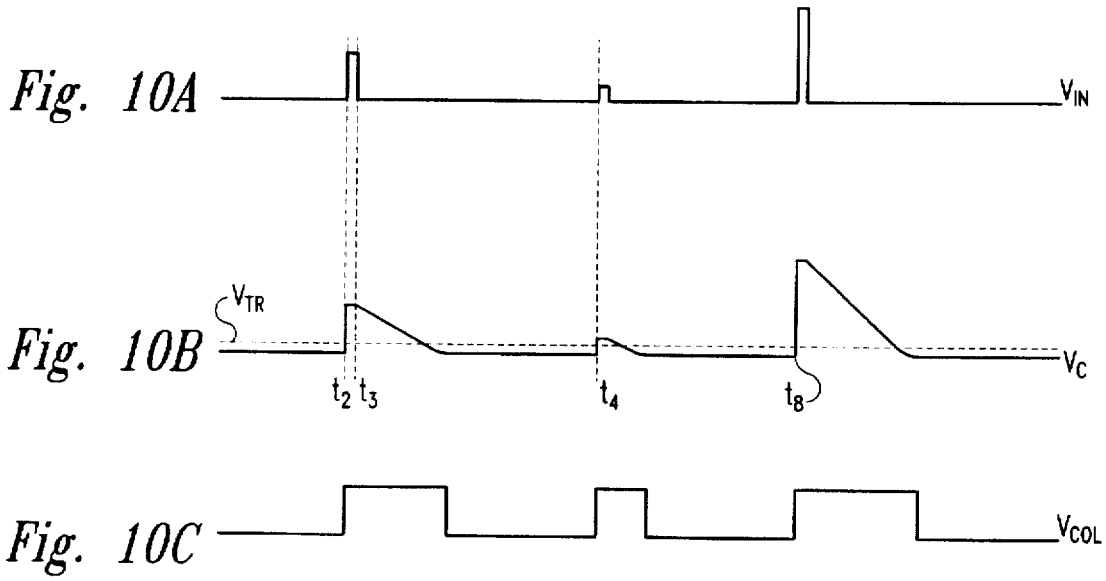

HIGH IMPEDANCE TRANSMISSION LINE TAP CIRCUIT

STATEMENT AS TO GOVERNMENT RIGHTS

This invention was made with government support under Contract No. DABT 63-93-C-0025 awarded by Advanced Research Projects Agency ("ARPA"). The government has certain rights in this invention.

TECHNICAL FIELD

The present invention relates to driving circuits, and more particularly driving circuits in transmission line taps in matrix addressable displays.

BACKGROUND OF THE INVENTION

Flat panel displays are widely used in a variety of applications, including computer displays. One suitable flat panel display is a field emission display. Field emission displays typically include a generally planar emitter substrate covered by a display screen. A surface of the emitter substrate has formed thereon an array of surface discontinuities or "emitters" projecting toward the display screen. In many cases, the emitters are conical projections integral to the substrate. Typically, contiguous groups of emitters are grouped into emitter sets in which the emitters in each emitter set are commonly connected.

The emitter sets are typically arranged in an array of columns and rows, and a conductive extraction grid is positioned above the emitters. All, or a portion, of the extraction grid is driven with a voltage of about 30–120 V. Each emitter set is then selectively activated by applying a voltage to the emitter set. The voltage differential between the extraction grid and the emitter sets produces an electric field extending from the extraction grid to the emitter set having a sufficient intensity to cause the emitters to emit electrons.

The display screen is mounted directly above the extraction grid. The display screen is formed from a glass panel coated with a transparent conductive material that forms an anode biased to about 1–2 kV. The anode attracts the emitted electrons, causing the electrons to pass through the extraction grid. A cathodoluminescent layer covers a surface of the anode facing the extraction grid so that the electrons strike the cathodoluminescent layer as they travel toward the 1–2 kV potential of the anode. The electrons striking the cathodoluminescent layer cause the cathodoluminescent layer to emit light at the impact site. Emitted light then passes through the anode and the glass panel where it is visible to a viewer. The light emitted from each of the areas thus becomes all or part of a picture element or "pixel."

The brightness of the light produced in response to the emitted electrons depends, in part, upon the rate at which electrons strike the cathodoluminescent layer. The light intensity of each pixel can thus be controlled by controlling the current available to the corresponding emitter set. To allow individual control of each of the pixels, the electric potential between each emitter set and the extraction grid is selectively controlled by a column signal and a row signal through corresponding drive circuitry. To create an image, the drive circuitry separately establishes current to each of the emitter sets.

In some embodiments, the voltage difference between the extraction grid and the emitter sets is controlled by setting the entire extraction grid to a single voltage and selectively coupling each emitter set to a reference potential, such as ground. One drawback of such an approach is that the drive circuitry for each of the emitter sets must respond to both the row signal and the column signal. This approach typically requires separate transistors or other current control elements for each of the row signal and the column signal such that each pixel requires at least a pair of current control elements.

Another approach to controlling the voltage differential between the extraction grid and the emitter sets is to divide the extraction grid into discrete sections each corresponding to a row of an array. The array of emitter sets is divided into discrete sections each corresponding to a column of the array. Each extraction grid row is connected to a respective row line while the emitters in each column are connected to each other and to a respective column line.

To activate this structure, one of the column lines is first grounded. Then, each of the row lines in the extraction grid is driven by a voltage corresponding to an image signal. To produce bright pixels, the row lines of the extraction grid are raised to a high voltage and to produce dim pixels, the row lines are held at a low voltage. The row lines arc therefore driven by rapidly switching, high analog voltages that require relatively expensive driver circuitry.

Another approach is to drive each of the row lines in the extraction grid with a constant magnitude voltage in response to the column signal and to drive column lines of the emitter substrate with analog voltages corresponding to the image signal. In this approach, the rows of the extraction grid are selectively biased at a constant grid voltage $V_G$, one row at a time. During the time a row of the extraction grid is biased, each column line of the emitter substrate receives an analog column voltage corresponding to an image signal. The column line establishes the voltages of the emitter sets. The emitter set intersecting the biased row of the extraction grid will therefore emit light when the column line voltage is sufficiently below the voltage of the biased extraction grid row. The intensity of the emitter light will depend upon the voltage of the column line. If the column line voltage is very far below the grid voltage $V_G$, the pixel will be bright. If the column line voltage is not very far below the grid voltage $V_G$, the pixel will be dim. This approach, like the above-described approach involves switching relatively high voltages and requires relatively expensive drive circuitry.

One approach to reducing the cost of driver circuitry for driving column lines of liquid crystal displays is presented in U.S. Pat. No. 5,519,414, to Gold et al. and assigned to Off World Laboratories, Inc., which is incorporated herein by reference. In this approach, pulses applied to transmission lines constructively interfere to produce selected voltages at selected tap locations. The high voltages drive row lines coupled to the taps to establish voltages of emitter sets coupled to the column lines.

One difficulty in this approach is the effect of the taps on signal propagation in the transmission line. Each of the taps can be modeled as a shunting impedance coupled to the transmission line. Each tap therefore can cause reflections or loss of signal strength. For a line with many taps, the loss and reflections become very substantial, and taps located distant from the transmission line input receive very low voltage signals.

One approach to increasing the available signals at distant taps is to increase the voltage of the input signal. However, the increased signal can be excessive for taps located close to the signal input. Moreover, this approach becomes even more difficult for field emission displays, because voltage swings in field emission displays are typically much larger than for LEDs.

SUMMARY OF THE INVENTION

A matrix addressable display includes a transmission line carrying image signals. Tapping circuits along the transmission line selectively tap the transmission line to provide the image signals to signal lines of an emitter substrate.

Each tapping circuit includes a switching assembly having a high impedance control port coupled to the transmission line. The switching assembly transfers charge from a charge source separate from the transmission line to a signal line in the field emission display in response to the transmission line signals received at the control port.

In an exemplary embodiment of the present invention, the switching assembly includes a charging and clearing circuit and a storage circuit. The charging and clearing circuit is a field effect transistor coupled between a supply voltage and the storage circuit. The gate of the transistor is coupled to a transmission line tap. The storage circuit is a discrete capacitor coupled between the signal line and the reference potential.

Pulses on the transmission line raise the gate voltage of the transistor above the capacitor voltage $V_C$. In response, the transistor turns ON and transfers charge from the supply voltage to the capacitor. As the capacitor charges, its voltage $V_C$ increases. When the capacitor voltage $V_C$ reaches the gate voltage of the transistor minus the threshold voltage $V_T$ of the transistor, the transistor turns OFF, trapping the charge on the capacitor.

Because the capacitor is coupled to a signal line of the field emission display, the capacitor voltage $V_C$ establishes the voltages of emitter sets coupled to the signal line. An extraction grid formed from several row lines establishes a high voltage of 30–120 V near selected ones of the emitter sets. If the voltage of a row line is high and the capacitor voltage $V_C$ is sufficiently low, an intense electric field extends from the extraction grid connected to the row line to the intersecting emitter set. The intense electric field causes the emitter set to emit electrons.

A display screen carrying a transparent conductive anode biased to about 1–2 kV is positioned opposite the emitter substrate and attracts the emitted electrons, causing the electrons to travel toward the screen. As the electrons travel toward the screen, they strike a cathodoluminescent layer covering the anode and cause the cathodoluminescent layer to emit light at the impact site.

The intensity of the emitted light is determined by the rate at which electrons are emitted by the emitter set. The rate at which electrons are emitted is determined, in turn, by the difference between the capacitor voltage $V_C$ and the voltage of the intersecting row line. As discussed above, the capacitor voltage $V_C$ is established by the magnitude of the pulses on the transmission line. Therefore, the magnitude of the pulses on the transmission line establish the intensity of the emitted light.

As electrons are emitted from the emitter set, electrons are drawn from the capacitor. This causes the capacitor voltage $V_C$ to rise slightly. However, the capacitor is large enough and the current draw of the emitter set is small enough that the capacitor voltage $V_C$ remains substantially constant over an expected refresh interval of the display.

To reduce the capacitor voltage $V_C$, and thereby increase the intensity of light, a clearing pulse from the supply voltage lowers the drain voltage of the transistor well below the gate voltage. In response, the transistor turns ON and pulls down the capacitor voltage $V_C$.

In a second exemplary embodiment of the invention, the charging and clearing circuit includes three field effect transistors and an intermediate capacitor. The first of the transistors is a charging transistor coupled between a DC supply voltage and the intermediate capacitor. The gate of the charging transistor is coupled to the transmission line tap. In response to pulses on the transmission line, the charging transistor turns ON and allows the supply voltage to raise the voltage $V_{CA}$ of the intermediate capacitor.

The second transistor is a discharging transistor coupled in parallel with the intermediate capacitor. The discharging transistor is a weak transistor having a low current carrying capability compared to that of the charging transistor. The gate of the discharging transistor is coupled to the output of the charging and clearing circuit.

The third transistor is an isolation transistor coupled between the intermediate capacitor and the storage circuit. The gate of the isolation transistor is coupled to the transmission line tap so that the isolation transistor is also turned ON by pulses on the transmission line. Therefore, when the charging transistor raises the intermediate capacitor voltage the charging transistor also raises the output voltage of the charging and clearing circuit. As the output of the charging and clearing circuit increases, it turns ON the discharging transistor. However, because the discharging transistor is weak compared to the charging transistor, the discharging transistor does not significantly lower the intermediate capacitor voltage $V_{CA}$.

The storage circuit includes a small capacitor and an output buffer circuit. The output buffer circuit is a conventional buffer amplifier having a high input impedance. In the exemplary embodiment, the buffer amplifier is a CMOS buffer. The storage capacitor is coupled between the storage circuit input and the reference potential. Therefore, when the charging transistor raises the intermediate capacitor voltage $V_{CA}$ and the output voltage of the charging and clearing circuit, the storage capacitor voltage $V_{CB}$ increases correspondingly. In response to the increased storage capacitor voltage $V_{CB}$, the output buffer provides an output signal to the signal line of the field emission display to selectively activate the emitter sets.

When the pulse on the transmission line ends, the charging transistor and the isolation transistor both turn OFF. The voltage $V_{CB}$ on the storage capacitor remains constant because the isolation transistor, the gate of the discharging transistor, and the input of the output buffer all present very high impedances.

The discharging transistor remains ON, because the storage capacitor voltage $V_{CB}$ keeps the gate voltage of the discharging transistor above the reference potential. Consequently, the discharging transistor continues to discharge the intermediate capacitor. Because the charging transistor is now OFF, the discharging transistor is now able to pull the intermediate capacitor voltage $V_{CA}$ down.

When a subsequent pulse of the tap voltage arrives, both the charging transistor and isolation transistor turn ON. However, the isolation transistor turns ON more quickly than the charging transistor, because the isolation transistor has a lower threshold voltage than the charging transistor. Consequently, the isolation transistor provides a path for charge on the storage capacitor to transfer to the intermediate capacitor. As charge transfers from the storage capacitor to the intermediate capacitor, the voltage $V_{CB}$ of the storage capacitor drops quickly. The voltage $V_{CA}$ of the intermediate capacitor remains substantially constant, because the intermediate capacitor is considerably larger than the storage capacitor. Consequently, the tapping circuit is "self-clearing" because the storage capacitor voltage $V_{CB}$ falls, i.e., is cleared, quickly before the charging transistor can establish the voltage of the intermediate capacitor and the storage capacitor.

The transmission line is preferably a serpentine microstrip line receiving a series of image pulses at one end and a control pulse at another end. As the image signal and control pulse travel along the microstrip line, they constructively interfere at respective ones of the taps to produce the desired input voltage for the charging and clearing circuit.

BRIEF DESCRIPTION OF THE DRAWINGS

FIG. 3A is a signal timing diagram showing the clearing voltage in the display of FIG. 1.

FIG. 3B is a signal timing diagram of an image signal in the display of FIG. 1.

FIG. 3C is a signal timing diagram of the capacitor voltage in the display of FIG. 1 in response to the clearing signal and image signal of FIGS. 3A–B.

FIG. 3D is a signal timing diagram of voltage on a first row line within the display of FIG. 1.

FIG. 3E is a signal timing diagram of a voltage on a second row line within the display of FIG. 1.

FIG. 3F is a timing diagram of a voltage on a third row line within the display of FIG. 1.

FIG. 4 is a schematic of a second embodiment of the tapping circuit of FIG. 1 including an intermediate storage circuit and isolation transistor for self-clearing.

FIG. 6A is a signal timing diagram of an image signal in the self-clearing tapping circuit of FIG. 4.

FIG. 6B is a signal timing diagram of voltage on an intermediate capacitor in the self-clearing tapping circuit of FIG. 4.

FIG. 6C is a signal timing diagram of voltage on a storage capacitor in the self-clearing tapping circuit of FIG. 4.

FIG. 8A is a signal timing diagram showing pulses traveling in opposite directions on the microstrip line of FIG. 7.

FIG. 8B is a diagram of a voltage at a tap due to constructive interference of the pulses traveling in opposite direction in FIG. 8A.

FIG. 9 is a schematic of a third embodiment of the tapping circuit of FIG. 1 including a fuser-selectable discharge of a storage circuit.

FIG. 10A is a signal timing diagram of an image signal in the tapping circuit of FIG. 9.

FIG. 10B is a signal timing diagram of a voltage on a storage capacitor in the tapping circuit of FIG. 9.

FIG. 10C is a signal timing diagram of a column voltage output from the tapping circuit of FIG. 9.

DETAILED DESCRIPTION OF THE INVENTION

Figure 1:
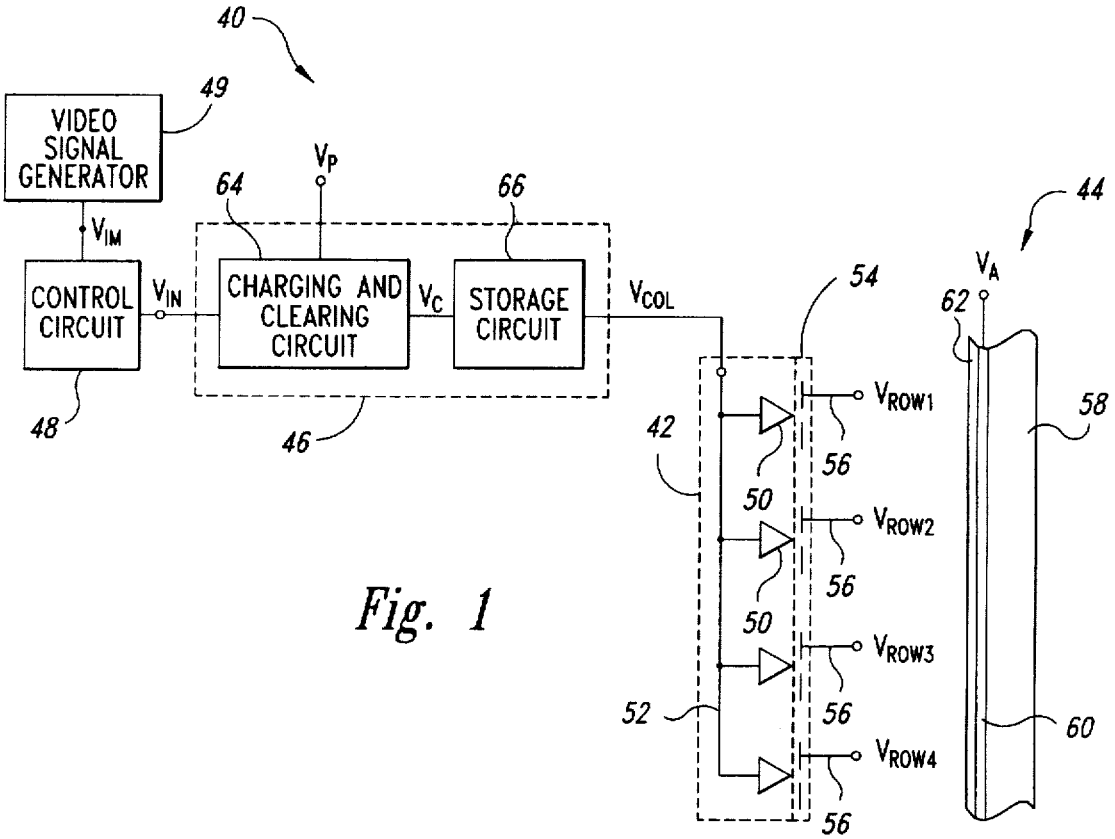
FIG. 1 is a schematic representation of a field emission display including a high impedance tapping circuit having a signal terminal and a clearing terminal.

As shown in FIG. 1, a field emission display 40 includes an emitter substrate 42, a display screen 44, a driving circuit 46 and a control circuit 48. The emitter substrate 42 includes four emitter sets 50 coupled to a column line 52. Although the emitter substrate 42 is represented by only a single column of four emitter sets 50 for clarity of presentation, one skilled in the art will recognize that such emitter substrates 42 typically are formed from an array of many columns with each column having many emitter sets 50. Also, although the emitter sets 50 are represented by a single conical emitter, one skilled in the art will recognize that such emitter sets 50 typically include several emitters that are commonly connected. Moreover, although the preferred embodiment of the display 40 employs an array of emitter sets 50, displays employing other light emitting assemblies, such as liquid crystal display elements, may also be within the scope of the invention.

Conductive extraction grids 54 are positioned above the emitter substrate 42. The extraction grids 54 are aligned along respective rows, each of which intersect all of the columns of emitter sets 50 on the emitter substrate 42. Each row of extraction grids 54 is connected to a respective row line 56.

The screen 44 is positioned opposite the emitter substrate 42 and the extraction grids 54. The screen 44 includes a transparent panel 58 having a transparent conductive anode 60 on a surface facing the emitter substrate 42. A cathodoluminescent layer 62 coats the anode 60 between the anode 60 and the extraction grids 54.

In operation, selected ones of the row lines 56 are biased at a grid voltage $V_G$ of about 30–120 V and the anode 60 is biased at a high voltage $V_A$, such as 1–2 kV. If an emitter set 50 is connected to a voltage much lower than the grid voltage $V_G$, such as ground, the voltage difference between the row line 56 and the emitter set 50 produces an intense electric field between the extraction grid in a row and the emitter set 50 in a column intersecting the row. The electric field causes the emitter set 50 to emit electrons according to the Fowler-Nordheim equation. The emitted electrons are attracted by the high anode voltage $V_A$ and travel toward the anode 60 where they strike the cathodoluminescent layer 62, causing the cathodoluminescent layer 62 to emit light around the impact site. The emitted light passes through the transparent anode 60 and the transparent panel 58 where it is visible to an observer.

The intensity of light emitted by the cathodoluminescent layer 62 depends upon the rate at which electrons emitted by the emitter sets 50 strike the cathodoluminescent layer 62. The rate at which the emitter sets 50 emit elections is controlled by the driving circuit 46 ill response to an input voltage $V_{IN}$ from the control circuit 48. The control circuit 48 is preferably a pulsed transmission line 90, as will be described in greater detail below with reference to FIGS. 7 and 8A–8B.

The driving circuit 46 includes two principal portions, a charging and clearing circuit 64 and a storage circuit 66. As will be discussed in greater detail below, the charging and clearing circuit 64 receives the input voltage $V_{IN}$ from the control circuit 48 and stores a corresponding voltage $V_C$ in the storage circuit 66. In response to the stored voltage $V_C$, the storage circuit 66 provides a column voltage $V_{COL}$ to the column line 52 to control the voltages of the emitter sets 50.

Figure 2:
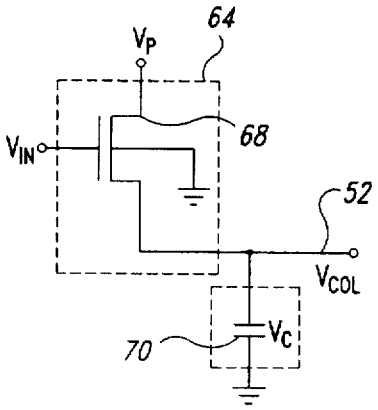
FIG. 2 is a schematic of an embodiment of the high impedance tapping circuit of FIG. 1 including a field effect transistor and capacitor.

FIG. 2 shows one embodiment of the driving circuit 46 where a control transistor 68 forms the charging and clearing circuit 64 and a capacitor 70 forms the storage circuit 66. The source of the control transistor 68 is coupled directly to the capacitor 70 and the column line 52. The gate of the control transistor 68 receives the input voltage $V_{IN}$ (FIG.

3B) from the control circuit 48. The operation of the driving circuit 46 of FIG. 2 is best described with reference to the signal timing diagrams of FIGS. 3A–3F.

The drain of the control transistor 68 receives a bias voltage $V_P$ as shown in FIG. 3A. The bias voltage $V_P$ is a constant high voltage of about 50 V, except during clearing, as will be described below.

The input voltage $V_{IN}$ is a series of variable amplitude pulses separated by a refresh interval $T_R$ as shown in FIG. 3B. At time $t_2$, a first pulse of the input voltage $V_{IN}$ arrives from the control circuit 48 (FIG. 1) with a voltage $V_A$. The pulse amplitude of the input voltage $V_{IN}$ is determined by an image signal $V_{IM}$ from a video signal generator 49, such as a television receiver, VCR, camcorder, computer or similar device. Development of the input voltage $V_{IN}$ will be described below with reference to FIGS. 7A and 8A–8B.

Assuming the capacitor voltage $V_C$ is originally at 0 V, as shown to the left of time $t_1$, in FIG. 3C, the control transistor 68 turns ON at time $t_2$ when the input voltage $V_{IN}$ rises above the threshold voltage $V_T$ of the control transistor 68. The ON control transistor 68 conducts current from the bias voltage $V_P$ to the capacitor 70. As the control transistor 68 conducts, the capacitor 70 charges and its voltage $V_C$ rises. The capacitor 70 continues to charge until it reaches a voltage $V_1$ which is equal to the input voltage $V_{IN}$ minus the threshold voltage $V_T$ of the control transistor 68. When the capacitor voltage $V_C$ reaches the voltage $V_1$, the gate-to-source voltage $V_{GS}$ of the control transistor 68 equals the threshold voltage $V_T$ and the control transistor 68 stops conducting. A short time later, at time $t_3$, the input voltage $V_{IN}$ returns low. The gate-to-source voltage $V_{GS}$ of the control transistor 68 becomes negative, ensuring the control transistor 68 is OFF. The control transistor 68 then presents an open circuit to prevent the capacitor 70 charge from discharging through the control transistor 68.

The capacitor voltage $V_C$ establishes the voltage of the column line 52 and thus the voltage of the emitter sets 50 coupled to the column line 52. The emitter sets 50 are thus biased at the voltage $V_1$ which is well below the voltage $V_{ROW1}$ of the first row line 56. During the time interval from time $t_2$ to time $t_3$ following the establishment of the capacitor voltage $V_C$, the remaining columns of the array are activated in a similar fashion. After activation of all of the driving circuits 46, a first of the row lines 56 is biased to a row voltage $V_{ROW1}$ of about 100 V at time $t_3$, as shown in FIG. 3D. The voltage differential between the first emitter set 50 and the extraction grids 54 connected to the first row line 56 causes the first emitter set 50 to emit electrons.

As mentioned above, the intensity of the emitted light is determined in part by the difference between the voltage on the emitter set 50 and the voltage on the extraction, grid 54 which is, in turn, determined by capacitor voltage $V_C$ and the row voltage $V_{ROW1}$. If the capacitor voltage $V_C$ is very high, the voltage difference between the first row line 56 and the first emitter set 50 will be very low and the first emitter set 50 will emit electrons at a low rate or not at all. If the capacitor voltage $V_C$ is very low, the voltage difference between the first row line 56 and the first emitter set 50 will be large, causing the first emitter set 50 to emit electrons at a high rate. Thus, the rate of electron emission and the intensity of the emitted light is determined by the capacitor voltage $V_C$.

As the first emitter set 50 emits electrons, the electrons are replaced by electrons from the capacitor 70. The capacitor voltage $V_C$ rises slightly, but remains substantially constant because the current draw of the emitter set 50 is very low compared to the storage capacity of the capacitor 70. The first emitter set 50 therefore continues to emit electrons over the entire refresh interval $T_R$.

Near the end of the refresh interval $T_R$, the voltage $V_{ROW1}$ on the first row line 56 returns low at time $t_4$ and the first emitter set 50 stops emitting electrons. A short time thereafter, at time $t_5$, a second pulse of the input voltage $V_{IN}$ arrives. The input voltage $V_{IN}$ charges the capacitor 70 to a voltage of $V_{IN}$ less the threshold voltage $V_T$ in the same manner as explained above with reference to the first pulse starting at $t_1$.

Then, at time $t_5$, a voltage $V_{ROW2}$ on a second row line 56 goes high. The voltage difference between the voltage $V_{ROW2}$ of the selected row line 56 and the capacitor 70 causes the second emitter set 50 to emit electrons in the same manner as explained above.

Because the amplitude of the second pulse of the input voltage $V_{IN}$ is greater than the amplitude of the first pulse, the capacitor voltage $V_C$ increases to the voltage $V_2$, thereby reducing the voltage difference between the second row line 56 and the emitter set 50. Consequently, the second emitter set 50 emits electrons at a lower rate than that of the first emitter set 50. Thus, the region above the second emitter set 50 will be more dim than the region above the first emitter set 50. At the end of the refresh interval, at time $t_8$, the voltage $V_{ROW2}$ of the second row line 56 returns low and the second emitter set 50 stops emitting electrons.

As can be seen from the above discussion of the first and second pulses of the input voltage $V_{IN}$, the capacitor voltage $V_C$ will increase in response to increasingly large pulse voltages. However, reducing the pulse voltages does not reduce the capacitor voltage $V_C$, because the control transistor 68 remains OFF if the input voltage $V_{IN}$ does not exceed the capacitor voltage $V_C$ by at least the threshold voltage $V_T$. Therefore, to reduce the capacitor voltage $V_C$, the capacitor 70 is cleared by a clearing pulse $V_{CP}$ of the bias voltage $V_P$, as shown at time $t_{10}$ in FIG. 3C. The clearing pulse $V_{CP}$ is a brief drop in the bias voltage $V_P$ that pulls down the drain voltage of the control transistor 68. At the same time, a pulse of the input signal $V_{IN}$ raises the gate voltage of the control transistor 68. The source of the control transistor 68 is held at the capacitor voltage $V_C$. Under these conditions ($V_{GATE}>V_{DRAIN}$), the control transistor 68 conducts current from its source to its drain. The capacitor voltage $V_C$ is therefore pulled down to the level of the clearing pulse $V_{CP}$.

A very short time later at time $t_{11}$, the clearing pulse $V_{CP}$ ends and a new pulse of the input voltage $V_{IN}$ arrives. As before, the capacitor voltage $V_C$ rises to the level of the input voltage $V_{IN}$ minus the threshold voltage $V_T$ of the control transistor 68. Because the third row line 56 is activated (FIG. 3F), the third emitter set 50 emits electrons at a rate corresponding to the voltage difference between the capacitor voltage $V_C$ and the third row line 56. A short time later at time $t_{12}$, the pulse of the input voltage $V_{IN}$ ends and the control transistor 68 turns OFF. The capacitor voltage $V_C$ once again remains at its new level because the control transistor 68 forms an open circuit. The voltage difference between the third row line 56 and the third emitter set 50 is greater than previously at $t_6$–$t_{10}$ because the capacitor voltage $V_C$ has been lowered. Therefore, the third emitter set 50 emits electrons at a higher rate than the second emitter set 50. The combination of the clearing pulse $V_{CP}$ and the pulse of the input signal $V_{IN}$ therefore discharge the capacitor 70 to increase the intensity of emitted light. Thus, the driving circuit 46 can establish the intensity of light from each emitter set 50 by establishing the capacitor voltage $V_C$ in response to pulses of the input signal $V_{IN}$ and clearing pulses $V_{CP}$. One skilled in the art will recognize that the low capacitor voltage $V_C$ in the very short interval between time $t_{10}$ and $t_{11}$ can be eliminated by controlling either or both of the clearing pulse voltage $V_{CP}$ or the input voltage $V_{IN}$ to limit the minimum capacitor voltage $V_C$. However, the effect of the low voltage on the overall brightness of the pixel is minimal, because the interval between time $t_{10}$ and time $t_{11}$ is a very small part of the overall activation time of the emitter set 50. Accordingly, the minimal effect of the brief interval is offset by the simplicity of establishing the fixed clearing pulse voltage $V_{CA}$.

The driving circuit 46 presents a very high impedance to the control circuit 48, because the gate of the control transistor 68 has an extremely high input impedance. Consequently, the driving circuit 46 does not load the control circuit 48 significantly.

FIG. 4 shows another embodiment of the driving circuit 46 that eliminates the use of the clearing pulse $V_{CP}$. In the driving circuit 46 of FIG. 4, the charging and clearing circuit 64 is formed from a charging transistor 72, a discharging transistor 74, an isolation transistor 76, and an intermediate capacitor 78. The charging transistor 72 is a conventional NMOS transistor coupled between a DC supply voltage $V_{DD}$ and the intermediate capacitor 78. The charging transistor 72 has a low channel resistance to allow the intermediate capacitor 78 to be charged quickly. The discharging transistor 74 has a high channel resistance relative to that of the charging transistor 72. Consequently, when both the charging transistor 72 and discharging transistor 74 are ON, the charging transistor 72 largely dictates a voltage $V_N$ at a node 80 between the transistors 72, 74.

The isolation transistor 76 is coupled between the node 80 and the storage circuit 66 to provide an output voltage to the storage circuit 66. The isolation transistor 76 is a conventional NMOS transistor with a low threshold voltage $V_T$. Only the gates of the charging and isolation transistors 72, 76 receive the input voltage $V_{IN}$. Because the gates present extremely high impedances, the driving circuit 46 of FIG. 4 presents a very high impedance to the control circuit 48 (FIG. 1). Consequently, the driving circuit 46 does not significantly load the control circuit 48.

Figure 5:
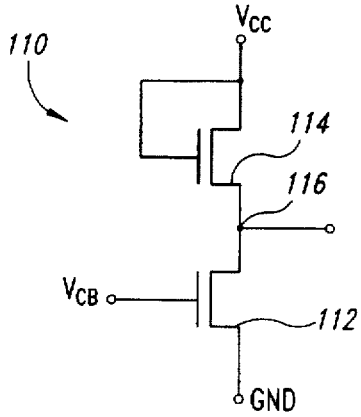
FIG. 5 is a schematic of an alternative embodiment of the output buffer of the tapping circuit of FIG. 4.

The storage circuit 66 is formed from a storage capacitor 82 and an output buffer 84. The storage capacitor 82 is small compared to the intermediate capacitor 78. For example, the storage capacitor 82 is about 10–50 pF while the intermediate capacitor 78 is about 1000 pF. The output buffer 84 is formed from an NMOS transistor 86 and a P)MOS transistor 88 serially coupled at an output node 102 between the supply voltage $V_{DD}$ and the reference potential. The bodies of the transistors 86, 88 are coupled to the output node 102 and the gates of the transistors 86, 88 are coupled to the storage capacitor 82. The output buffer 84 thus forms a CMOS buffer having a high input impedance to drive the column line 52. One skilled in the art will recognize several suitable circuits for realizing the output buffer 84. For example, the output buffer 84 can be realized by an NMOS transistor amplifier 110 as shown in FIG. 5. The amplifier 110 is a conventional amplifier structure formed from an NMOS transistor 112 that receives the voltage $V_{CB}$ from the storage capacitor 82 at its gate. The source of the NMOS transistor 112 is grounded and the drain is biased through a diode-coupled biasing transistor 114 to the supply voltage $V_{DD}$. The output of the amplifier 110 is taken from a node 116 between the biasing transistor 114 and the NMOS transistor 112. As is known, such amplifiers provide a gain that depends upon the characteristics of the transistors 112, 114 and present a very high input impedance.

The operation of the driving circuit 46 of FIG. 4 is best explained with reference to the signal timing diagrams of FIGS. 6A–6C. It will be presumed for purposes of this discussion that the input voltage $V_{IN}$ and the voltages $V_{CA}$, $V_{CB}$ on the capacitors 78, 82 are all initially 0 V, at time $t_1$. At time $t_2$l the control circuit 48 (FIG. 1) outputs a pulse of the input voltage $V_{IN}$ (FIG. 6A). The pulse raises the gate voltage of the charging transistor 72 above the node voltage $V_N$, turning ON the charging transistor 72. The charging transistor 72 conducts current from the supply voltage $V_{DD}$ to charge the capacitor 78. At the same time, the input pulse arrives at the isolation transistor 76, turning ON the isolation transistor 76, so that the capacitors 78, 82 are effectively connected in parallel. Thus, current from the charging transistor 72 charges both the intermediate capacitor 78 and the storage capacitor 82, as shown in FIGS. 6B, 6C. As the capacitors 78, 82 charge, the voltage of the node $V_N$ rises until the gate-to-source voltage of the charging transistor 72 falls below its threshold voltage $V_T$. When the node voltage $V_N$ reaches the input voltage $V_{IN}$ minus the threshold voltage $V_T$ of the charging transistor 72, the charging transistor 72 turns OFF. The isolation transistor 76 remains ON because its threshold voltage $V_T$ is less than the threshold voltage $V_T$ of the charging transistor 72.

As the voltage $V_{CB}$ of the storage capacitor 82 rises, the gate voltage of the discharging transistor 74 increases, because a feedback line 75 couples the storage capacitor voltage $V_{CB}$ to the gate of the discharging transistor 74. Thus, the discharging transistor 74 is also ON. However, as noted above, the discharging transistor 74 has a high resistance compared to the charging transistor 72 so that the discharging transistor 74 does not significantly pull down the node voltage $V_N$. The node voltage $V_N$ thus remains substantially at the input voltage $V_{IN}$ minus the threshold $V_T$ of the charging transistor 72, even when the discharging transistor 74 is ON.

After the capacitors 78, 82 are charged, the input voltage $V_{IN}$ returns low at time $t_3$. The gate voltages of the transistors 72, 76 are both pulled below the capacitor voltages $V_{CA}$, $V_{CB}$ so that both transistors 72, 76 turn OFF. The charge on the storage capacitor 82 is trapped, because the output buffer 84, the isolation transistor 76, and the discharging transistor 74 all present high impedance to the storage capacitor 82. Thus, the voltage $V_{CB}$ on the storage capacitor 82 remains constant.

The capacitor voltage $V_{CB}$ drives the output buffer 84. In response, the output buffer 84 provides a corresponding column voltage $V_{COL}$. to the column line 52 (FIG. 1). In response to the column voltage $V_{COL}$ and the voltage on selected row lines 56 (FIG. 1), the emitter sets 50 (FIG. 1) emit electrons, as described above.

In addition to driving the output buffer 84, the storage capacitor voltage $V_{CB}$ also drives the gate of the discharging transistor 74 to keep the discharging transistor 74 ON. The discharging transistor 74 thus provides a current path to discharge the intermediate capacitor 78. Consequently, the voltage $V_{CA}$ on the intermediate capacitor 78 falls to the reference potential, as shown in FIG. 6B.

After the intermediate capacitor voltage $V_{CA}$ falls, the voltages $V_{CA}$, $V_{CB}$ remain at the above described voltages until a subsequent pulse of the input signal $V_{IN}$ is received at time $t_4$. The pulse of the input voltage $V_{IN}$ raises the gate voltages of the charging transistor 72 and isolation transistor 76 above the intermediate capacitor voltage $V_{CA}$ and thus turns ON the transistors 72, 76. The discharging transistor 74 is already ON, because the storage capacitor voltage $V_{CB}$ is high. The input voltage $V_{IN}$ turns ON the transistors 72, 76 so that current from the supply voltage $V_{DD}$ can charge the capacitors 78, 82. However, the isolation transistor 76 turns ON slightly before the charging transistor 72 because the threshold voltage $V_T$ of the isolation transistor 76 is lower than the threshold voltage of the charging transistor 72. The isolation transistor 76 thus provides a path to the storage capacitor 82 to "dump" charge to the intermediate capacitor 78. That is, the capacitors 78, 82 are effectively coupled in parallel when the isolation transistor 76 is ON, although the storage capacitor voltage $V_{CB}$ is initially greater than the intermediate capacitor voltage $V_{CA}$. Thus, charge stored on the storage capacitor 82 will transfer to the intermediate capacitor 78 to equalize the voltages $V_{CA}$, $V_{CB}$. In response to the charge transfer, the voltage $V_{CA}$ on the intermediate capacitor 78 rises only slightly (FIG. 6B) while the voltage $V_{CB}$ on the storage capacitor 82 drops almost to 0 V at time $t_5$ (FIG. 6C), because the intermediate capacitor 78 is substantially larger than the storage capacitor 82. After the charge from the storage capacitor 82 is redistributed between the storage and intermediate capacitors 78, 82, the voltages $V_{CA}$, $V_{CB}$ are substantially equal at time $t_5$, neglecting voltage drop across the isolation transistor 76.

Eventually, current from the charging transistor 72 raises the voltages $V_{CA}$, $V_{CB}$ of the capacitors 78, 82, as described previously. Once again, the low resistance of the charging transistor 72 overwhelms the high resistance of the discharging transistor 74 so that the node voltage $V_N$ becomes substantially equal to the input voltage $V_{IN}$ minus the threshold voltage $V_T$ of the charging transistor 72 at time $t_6$.

A short time later at time $t_7$, the input voltage $V_{IN}$ returns low, turning OFF the charging transistor 72 and the isolation transistor 76. The storage capacitor voltage $V_{CB}$ remains substantially constant, because the output buffer 84, the isolation transistor 76 and the discharging transistor 74 present high impedances. The storage capacitor voltage $V_{CB}$ keeps ON the discharging transistor 74 to discharge the intermediate capacitor 78. The intermediate capacitor voltage $V_{CA}$ falls after time $t_7$, as shown in FIG. 6B.

Later, at time $t_8$, another pulse of the input voltage $V_{IN}$ arrives and turns ON the transistors 72, 76. As described above, charge on the storage capacitor 82 is redistributed between the capacitors 78, 82 until the capacitor voltages $V_{CA}$, $V_{CB}$ are substantially equal at time $t_9$. Thus, the intermediate capacitor voltage $V_{CA}$ rises slightly (FIG. 6B) and the storage capacitor voltage $V_{CB}$ falls quickly (FIG. 6C). After the charge is redistributed between the capacitor 78, 82, the current from the charging transistor 72 charges both capacitors 78, 82. Once again, the relatively high resistance of the discharging transistor 74 allows the charging transistor 72 to establish the node voltage $V_N$ and thus the intermediate capacitor voltage $V_{CA}$ at the input voltage $V_{IN}$ minus the threshold voltage $V_T$ of the charging transistor 72.

Unlike the driving circuit 46 of FIG. 2, the driving circuit 46 of FIG. 4 is sell-clearing. That is, the discharging transistor 74 and intermediate capacitor 78 provide a path to remove charge from the storage capacitor 82. This pulls down the storage capacitor voltage $V_{CB}$ at the beginning of each pulse of the input voltage $V_{IN}$. Thus, the driving circuit 46 of FIG. 4 requires no clearing pulse $V_{CP}$ to increase or decrease the storage capacitor voltage $V_{CB}$. This simplifies the demands on the control circuit 48 by requiring only a single input voltage $V_{IN}$ to establish the column line voltage $V_{COL}$.

Figure 7:
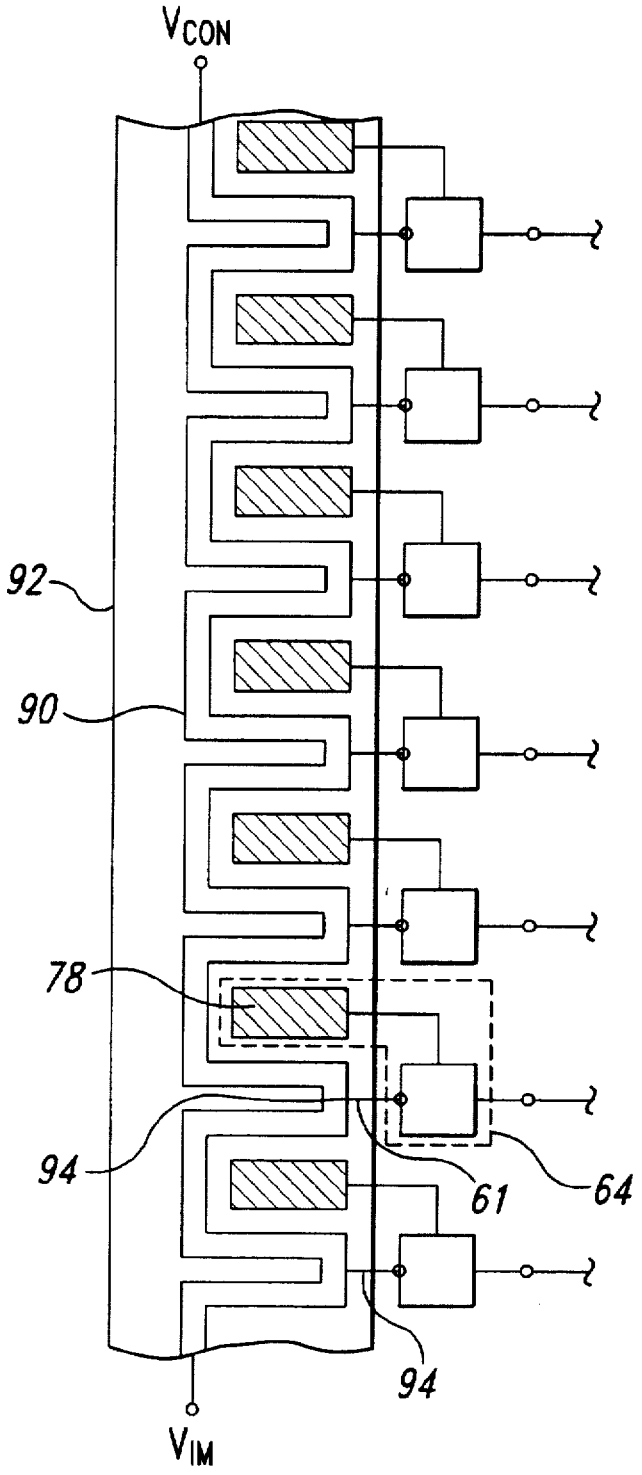
FIG. 7 is a partial schematic, partial top plan view of a microstrip delay line and storage capacitor formed on a common substrate within the display of FIG. 1.

FIG. 7 shows one structure for producing and supplying the signal pulses of FIGS. 3B and 6A that also incorporates the intermediate capacitor 82. As shown in FIG. 7, a transmission line 90 is formed on a high dielectric substrate 92 in a serpentine pattern. The transmission line 90 is preferably a microstrip, although other transmission line structures, such as strip lines, may also be within the scope of the invention. Several equally spaced taps 94 along the transmission line 90 are coupled to respective driving circuits 46 to provide the column signal $V_{COL}$ described above with respect to FIGS. 1, 2, 3A, and 4.

Generation of the signals of FIGS. 3B and 6A is best described with reference to FIGS. 7 and 8A–8B. The transmission line 90 receives the image signal $V_{IM}$ at its left end and a control pulse $V_{CON}$ at its right end. As shown in FIG. 8A, the image signal $V_{IM}$ is a pulse train having equally spaced variable amplitude pulses. As will be explained below, the amplitude of each pulse is inversely proportional to the brightness of a pixel on a corresponding column. The control pulse $V_{CON}$ is input to the right end of the transmission line 90 and is a fixed amplitude pulse.

As the control pulse $V_{CON}$ travels from right to left along the transmission line 90, the control pulse $V_{CON}$ intercepts each successive pulse of the image signal $V_{IM}$. The relative timing of the image signal $V_{IM}$ and the control pulse $V_{CON}$ are carefully controlled such that the control pulse intercepts each successive pulse of the image signal $V_{IM}$ at successive ones of the taps 94. Each control pulse $V_{CON}$ constructively interferes with a pulse of the image signal $V_{IM}$ to produce a composite signal at each of the taps 94.

For example, the last pulse 100 of the image signal $V_{IM}$ arrives at the leftmost tap 94 simultaneously with the control pulse $V_{CON}$. The last pulse 100 and the control pulse $V_{CON}$ constructively interfere to produce a tap voltage having a magnitude that is the sum of the magnitudes of the last pulse 100 and the control pulse $V_{CON}$. When the last pulse 100 and control pulse $V_{CON}$ leave the tap 94, the tap voltage returns to the reference voltage. One skilled in the art will recognize that each of the taps 94 receives a similar signal pulse if each successive pulse of the image signal $V_{IM}$ is timed to constructively interfere with the control pulse $V_{CON}$ at each successive tap 94. For example, the second-to-last pulse of the image signal $V_{IM}$ arrives at the second tap 94 from the left simultaneously with the control pulse $V_{CON}$. Similarly, the first pulse of the image signal $V_{IM}$ arrives at the rightmost tap 94 simultaneously with the control pulse $V_{CON}$. The constructively interfered pulses therefore provide the signal pulses described above with respect to FIG. 3B and 6A to each of the driving circuits 46, although the pulse of the image signal $V_{IM}$ would be modified slightly for clearing the capacitor 70 of FIG. 2.

The separation between pulses at subsequent taps 94 is determined by the distance between successive taps 94 and the propagation velocity of pulses along the transmission line 90. To slow propagation of the control pulse $V_{CON}$ and the image signal $V_{IM}$ along the transmission line 90, the dielectric constant of the substrate 92 is very high. The slow propagation of the signals $V_{IM}$, $V_{CON}$ facilitates timing of the arrivals of pulses at the successive taps 94 by increasing the time between arrival of successive pulses of the image signal $V_{IM}$ at each tap 94 without requiring an excessively long transmission line 90.

Each of the driving circuits 46 of FIGS. 2 and 4 presents a very high impedance to the control circuit 48. Consequently, the taps 94 are coupled to an effectively open circuits regardless of the magnitude of the input voltage $V_{IN}$.

Therefore, the driving circuits 46 do not draw significant current from the transmission line 90.

The preferred embodiment of the present invention takes advantage of the high dielectric constant and the substantial surface area between adjacent turns of the serpentine transmission line 90 by forming one plate of the intermediate capacitor 78 directly on the upper surface of the substrate 92. The lower surface of the substrate 92, which is the ground plane of the microstrip transmission line 90, forms the second plate of the intermediate capacitor 78. The high dielectric constant of the substrate 92 and the large available area between successive turns of the transmission line 90 allow the intermediate capacitor 82 to be fabricated with a relatively high capacitance on the order of 1000 pF. Thus, the substrate 92 carries both the transmission line 90 and the capacitors 78, eliminating the need for discrete intermediate capacitors 78 elsewhere in the display 40. The intermediate capacitors 78 thereby utilize the "dead" space between adjacent turns of the transmission line 90. Also, both the transmission line 90 and the intermediate capacitors 78, 82 can be fabricated using compatible, conventional techniques, easing fabrication of the structure.

The storage capacitor 82 is not formed on the substrate 92, because the storage capacitor 82 can be very small and thus can be realized on a common substrate with the transistors 74, 76, 86, 88. In fact, because current leakage from the storage capacitor 82 is extremely small, the storage capacitor 82 can be realized with inherent parasitic capacitances of the transistors 74, 76, 86, 88 and of the feedback line 75.

FIG. 9 shows another embodiment of the driving circuit 46 that incorporates a charging and clearing circuit 144 where discharging through the discharging transistor 74 is at a constant rate selectable by an operator. Several of the circuit elements in FIG. 9 are analogous to those of FIG. 4 and are numbered identically. Unlike the charging and clearing circuit 64 of FIG. 4, the charging and clearing circuit 144 of FIG. 9 eliminates the isolation transistor 76 and the intermediate capacitor 78. Instead, the charging and clearing circuit 144 discharges the storage capacitor 82 at a fixed rate with a mirror current $I_{REF2}$ that flows through the discharging transistor 74. The magnitude of the mirror current $I_{REF2}$ is controlled by controlling the gate voltage of the discharging transistor 74 with a biasing circuit 146 formed from a pair of NMOS transistors 148, 150 serially coupled between the supply voltage $V_{DD}$ and ground. The lower transistor 150 is diode coupled and the gate of the upper transistor 148 is controlled by an externally supplied control voltage $V_{CON}$. Therefore, the upper transistor 148 establishes a reference current $I_{REF1}$ through the lower transistor 150 in response to the control voltage $V_{CON}$. The reference Current $I_{REF1}$ establishes the (gate-to-source voltage of the lower transistor 150 and thus the gate-to-source voltage of the discharging transistor 74, because the gates of the lower transistor 150 and the discharging transistor 74 are connected and the sources of the lower transistor 150 and the discharging transistor 74 are both coupled to ground. Therefore, the gate-to-source voltages of the lower transistor 150 and the discharging transistor 74 are identical.

The mirror current $I_{REF2}$ will track the reference current $I_{REF1}$, because the channel lengths and widths of the transistors 74, 150 are matched. Thus, a user can control the mirror current $I_{REF2}$ by establishing the control voltage $V_{CON}$.

Operation of the driving circuit 46 of FIG. 9 is best explained with reference to the signal timing diagrams of FIGS. 10A–10C where it is assumed that the capacitor voltage $V_C$ and the column voltage $V_{COL}$ are low initially. As shown in FIG. 10A, the input voltage $V_{IN}$ is a series of pulses having variable amplitudes that arrive at time $t_2$, time $t_4$, and time $t_8$. In response to the first pulse of the input voltage at time $t_2$, the charging transistor 72 turns on and current flows from the supply voltage $V_{DD}$ through the charging transistor 72 to the storage capacitor 82. The voltage $V_C$ of the storage capacitor 82 rises quickly, as shown in FIG. 10B, until capacitor voltage $V_C$ reaches the input voltage $V_{IN}$ minus the threshold voltage $V_T$ of the charging transistor 72. In response, the column voltage $V_{COL}$ goes low as shown in FIG. 10C. While the charging transistor 72 is ON, the discharging transistor 74 continues to draw the mirror current $I_{REF2}$. However, the channel resistance of the discharging transistor 74 is much larger than the channel resistance of the charging transistor 72, such that the discharging current $I_{REF2}$ does not significantly affect the voltage of the storage capacitor 82.

At time $t_3$, the input voltage $V_{IN}$ falls, thereby turning off the charging transistor 72. The capacitor 82 continues to discharge through the discharging transistor 74 and the capacitor voltage $V_C$ begins to fall at a constant rate due to the fixed mirror current $I_{REF2}$, as shown in FIG. 10B. The capacitor voltage $V_C$ continues to fall until the storage capacitor 82 is fully discharged. When the capacitor voltage $V_C$ equals the trip voltage of the output buffer 84, the column voltage $V_{COL}$ returns high.

As can be seen from FIGS. 10A–10C, the time during which the column voltage $V_{COL}$ remains high after each input pulse depends upon the magnitude of the input pulse and upon the rate at which the capacitor 82 discharges. The magnitude of the input pulse depends upon the information contained in the image signal $V_{IM}$. The discharge rate of the capacitor 82 is controlled by the magnitude of the mirror current $I_{REF2}$, which is controlled in turn by the control voltage $V_{CON}$. Consequently, the width of pulses of the column voltage $V_{COL}$ can be controlled by the image signal $V_{IM}$ and the control voltage $V_{CON}$.

As noted above, the amount of light energy emitted in response to each pulse will depend upon the number of electrons emitted by the emitter set 50 (FIG. 1) during each activation interval of the emitter set 50. The number of electrons emitted by the emitter set 50 will depend in turn upon the width of the pulses of the column voltage $V_{COL}$. Thus, the input voltage $V_{IN}$ controls the amount of light emitted by modulating the relative width of pulses of the column voltage $V_{COL}$. Unlike the previously discussed embodiments, the column voltage $V_{COL}$ goes low in response to pulses of the input voltage $V_{IN}$, rather than high. The brightness of the display will thus correspond directly, rather than inversely, to the magnitude of the input voltage $V_{IN}$. Also, the user can adjust the response level of the column of emitter set 50 by adjusting the control voltage $V_{CON}$ to select the rate of discharge of the capacitor 82.

While the present invention has been described by way of exemplary embodiments, various modifications to the embodiments described herein can be made without departing from the scope of the invention. For example, other sell clearing mechanisms may be within the scope of the invention. Additionally, the circuit structures described herein can be applied to selectively drive the extraction grid 54, although the polarities of the signals would be reversed. Additionally, the signal lines (i.e., row and column lines) can be transposed such that the circuits described herein drive row lines 56 rather than column lines 52. Similarly, the biasing voltages, signal voltages and timing may be modified for specific applications. Accordingly, the invention is not limited, except as by the appended claims.

We claim:

1. A tapping circuit for providing a driving signal to a plurality of signal lines in response to respective input signals from a transmission line, comprising:

a plurality of taps on the transmission line, a charge source separate from the transmission line to provide a charge level independent of the number of taps in the plurality of taps; and a plurality of switching assemblies each including at least one transistor having a high impedance gate coupled to a respective one of the taps, each of the switching assemblies coupling the charge source to a respective one of the signal lines to provide the driving signal to the signal line in response to the input signal.

2. The tapping circuit of claim 1 wherein the tapping circuit further includes a plurality of primary storage circuits each coupled to store a charge representative of a respective one of the input signals, wherein the charge source is coupled to provide the charge to a respective one of the primary storage circuits and wherein the switching assemblies produce the driving signal in response to the stored charge.

3. The tapping circuit of claim 2, further including a plurality of isolation circuits each coupled to isolate a respective one of the primary storage circuits from the tap.

4. The tapping circuit of claim 3 wherein each of the switching assemblies further includes an output buffer having a high impedance gate coupled to a respective one of the primary storage circuits, the buffer circuit being configured to produce the driving signal in response to the stored voltage.

5. The tapping circuit of claim 3 wherein each of the switching assemblies further includes an intermediate storage circuit coupled between a respective one of the primary storage circuits and the tap.

6. The tapping circuit of claim 5, further including a plurality of discharging circuits each coupled to discharge a respective one of the intermediate storage circuits.

7. The tapping circuit of claim 6 wherein each of the discharging circuits includes an activation input coupled to the respective primary storage circuit.

8. The tapping circuit of claim 5 wherein each of the isolation circuits is coupled to isolate the respective primary storage circuit from the intermediate storage circuit.

9. The tapping circuit of claim 8 wherein the primary and intermediate storage circuits include respective capacitances and the capacitance of each of the primary storage circuits is smaller than the capacitance of a respective one of the intermediate storage circuits.

10. The tapping circuit of claim 8 wherein the capacitance of the primary storage circuit is solely a parasitic capacitance.

11. The tapping circuit of claim 2, further including a plurality of discharge circuits each coupled to a respective one of the primary storage circuits.

12. The tapping circuit of claim 11 wherein each of the discharge circuits is configured to discharge the respective primary storage circuit at a constant rate.

13. The tapping circuit of claim 12 wherein the constant rate is selectable by a control signal.

14. A tapping circuit for tapping a transmission line to provide a signal to a signal line in a matrix addressable display, comprising:

a charging source separate from the transmission line to provide a charge level independent of the number of tapping circuits on the transmission line; and a switching circuit comprising a transistor having a high impedance gate, an input terminal and an output terminal, the gate being coupled to the transmission line, the input terminal being coupled to the charging source and the output terminal being coupled to the signal line, wherein the switching circuit is responsive to transfer charge from the input terminal to the output terminal in response to a transmission line voltage having a magnitude greater than a threshold voltage magnitude.

15. The tapping circuit of claim 14 wherein the switching circuit includes a primary storage circuit coupled to receive charge from the charging source.

16. The tapping circuit of claim 15 wherein the switching circuit further includes a discharging circuit coupled to discharge the primary storage circuit.

17. The tapping circuit of claim 15, further including an isolation circuit coupled to isolate the primary storage circuit from the discharging circuit in response to a selected transmission line voltage.

18. A line activation circuit for driving a signal line, comprising:

a transmission line;

a plurality of taps on the transmission line;

a plurality of output terminals; and a plurality of switching circuits each of the switching circuits coupled between a respective one of the output terminals and a charge source separate from the transmission line to provide a charge level independent of the number of taps on the transmission line, the switching circuits each including a primary storage circuit, the switching circuits each being configured to store charge from the charge source in the primary storage circuit in response to a signal at a respective one of the taps.

19. The line activation circuit of claim 18, further including:

a plurality of discharging circuits each coupled to a respective one of the switching circuits, the discharging circuits each having an activation input, the discharging circuits each being coupled to discharge a portion of the stored charge in response to an activation signal at the activation input.

20. The line activation circuit of claim 19 wherein each of the switching circuits further includes:

an intermediate charge storage circuit; and an isolation circuit coupled between the primary and intermediate charge storage circuits.

21. The line activation circuit of claim 20 wherein the isolation circuit includes a control input coupled to the tap.

22. A matrix addressable display, comprising:

an input terminal;

a transmission line coupled to the input terminal;

a plurality of taps on the transmission line;

a plurality of output terminals;

a charge source different from the transmission line to provide a charge level independent of the number of taps on the transmission line;

a plurality of switching circuits each coupled between the charge source and a respective one of the output terminals, the switching circuits configured to store charge from the charge source in response to a signal at a respective one of the taps; and an array of light-emitting assemblies wherein a plurality of the light-emitting assemblies are coupled respectively to each of the output terminals, and are responsive to emit light in response to the stored charge.

23. The display of claim 22, further including:

a plurality of discharging circuits each coupled to a respective one of the switching circuits, each of the discharge circuits having an activation input, each of the discharge circuits being coupled to discharge a portion of the stored charge in response to an activation signal at the activation input.

24. The display of claim 23 wherein each of the switching circuits further includes:

a primary charge storage circuit;

an intermediate charge storage circuit; and an isolation circuit coupled between the primary and intermediate charge storage circuits.

25. A method of tapping a transmission line to produce a line driving signal, comprising:

applying an input signal to the transmission line to induce a selected voltage at a first one of a plurality of tap locations;

sensing a voltage at the first tap location with a high impedance gate of a transistor;

storing a charge from a charge source to a primary storage circuit in response to the sensed voltage to produce a stored voltage the charge source being different from the transmission line to provide a charge level independent of the number of tap locations;

maintaining the stored charge after completing the step of sensing a voltage at the first tap location; and producing the line driving signal in response to the maintained stored voltage.

26. The method of claim 25, further including electrically isolating the primary storage circuit from the first tap location after transferring the charge.

27. The method of claim 26 wherein electrically isolating the storage circuit comprises turning off the transistor.

28. The method of claim 26 wherein transferring charge comprises transferring charge to an intermediate storage circuit.

29. The method of claim 28, further including transferring charge from the intermediate storage circuit to a primary storage circuit.

30. The method of claim 29, further including isolating the primary storage circuit from the intermediate storage circuit.

31. The method of claim 30, further including discharging the intermediate storage circuit.

32. The tapping circuit of claim 1 wherein the charge source comprises a common charge supply coupled to more than one of the plurality of the switching assemblies.

33. The line activation circuit of claim 18 wherein the charge source comprises a common charge supply coupled to more than one of the plurality of switching circuits.

34. The matrix addressable display of claim 22 wherein the charge source comprises a common charge supply coupled to more than one of the plurality of the switching circuits.

* * * * *